US008268084B2

(12) United States Patent
Roscoe

(10) Patent No.: US 8,268,084 B2
(45) Date of Patent: Sep. 18, 2012

(54) LIQUID INJECTION INTO GAS STREAM

(75) Inventor: Keith Roscoe, Stockport (GB)

(73) Assignee: Whirlwind Technologies Limited, Manchester (GB)

( * ) Notice: Subject to any disclaimer, the term of this patent is extended or adjusted under 35 U.S.C. 154(b) by 1038 days.

(21) Appl. No.: 11/914,898

(22) PCT Filed: May 17, 2006

(86) PCT No.: PCT/GB2006/001816

§ 371 (c)(1),
(2), (4) Date: Jul. 14, 2008

(87) PCT Pub. No.: WO2006/123142

PCT Pub. Date: Nov. 23, 2006

(65) Prior Publication Data

US 2009/0211608 A1 Aug. 27, 2009

(30) Foreign Application Priority Data

May 17, 2005 (GB) ..... 0510021.9

(51) Int. Cl.
*B08B 9/027* (2006.01)

(52) U.S. Cl. ..... 134/22.11; 134/166 C; 134/167 C; 134/168 C; 134/169 C

(58) Field of Classification Search ..... 261/115; 134/166 C, 167 C, 168 C, 169 C
See application file for complete search history.

(56) References Cited

U.S. PATENT DOCUMENTS

| | | | | |
|---|---|---|---|---|
| 2,977,201 | A * | 3/1961 | Stephens | 422/648 |
| 3,048,956 | A * | 8/1962 | Lundy et al. | 96/312 |
| 4,618,350 | A * | 10/1986 | Rowe et al. | 95/203 |
| 5,375,995 | A * | 12/1994 | Dobbeling et al. | 431/8 |
| 5,474,097 | A * | 12/1995 | Lowe et al. | 134/104.4 |
| 5,680,765 | A * | 10/1997 | Choi et al. | 60/740 |
| 6,034,288 | A * | 3/2000 | Scott et al. | 570/102 |
| 6,067,790 | A * | 5/2000 | Choi et al. | 60/776 |
| 2001/0012910 | A1 * | 8/2001 | Scott et al. | 570/202 |
| 2004/0124259 | A1 * | 7/2004 | Guezennec et al. | 239/135 |
| 2006/0086673 | A1 * | 4/2006 | Titmas | 210/761 |
| 2007/0251383 | A1 * | 11/2007 | Mueller | 95/216 |

* cited by examiner

*Primary Examiner* — Duane Smith
*Assistant Examiner* — Christopher P Jones
(74) *Attorney, Agent, or Firm* — Woodard, Emhardt, Moriarty, McNett & Henry, LLP

(57) ABSTRACT

A liquid injection device (11) for injecting cleaning liquids into an airflow, comprises: an airflow duct (12); a jacket (13) surrounding the airflow duct, in two parts (13*a*, 13*b*), axially separable, and having liquid infeed and drain openings (15); at least one nozzle unit (16) having an inlet opening (16*a*) onto the jacket, and its nozzle outlet opening (16*b*) into the airflow duct; the parts of the jacket being sealingly juxtaposed for use, and separable for access to said nozzle unit.

7 Claims, 3 Drawing Sheets

LIQUID INJECTION INTO GAS STREAM

This invention relates to injecting liquids into a gas stream, and has particular application to pipe clearing and cleaning and general surface cleaning using cleaning fluids such as water with detergent and organic solvents in a 'lean phase' mode.

In pipe clearing according to WO 0117700, pipe content is displaced by a first, high pressure (order of 1 bar), low speed air flow, which, depending on the nature of the contents, displaces contents as a plug, followed by a low pressure, high velocity (order of 5 m/s) airflow, which strips the pipe wall of most residual content. Usually, a film remains, which must be removed by washing. Washing in the usual way, by sending quantities of washing liquid though the pipe, is wasteful of washing liquid, and gives rise to disposal problems. Where the washing liquid is an organic solvent, or, for certain materials, such as scale in sub-sea oil pipelines, strong acids or caustic solutions, the quantities of washing liquids used can occasion environmental problems, and may, in certain applications, be prohibited by environmental regulations.

The use of large quantities of liquids can be avoided by presenting them as a mist of droplets and swirling the airflow so that the droplets contact the pipe wall.

The present invention provides a device particularly adapted to introducing liquids in controlled amounts into an airflow for the purpose of cleaning pipe walls (and, indeed, other surfaces) by lean phase mode cleaning techniques.

The invention comprises a liquid injection device for injecting cleaning liquids into an airflow, comprising:

- an airflow duct;
- a jacket surrounding the airflow duct, in two parts, axially separable, and having liquid infeed and drain openings;
- at least one nozzle unit having an inlet opening onto the jacket, and its nozzle outlet opening into the airflow duct;
- the parts of the jacket being sealingly juxtaposed for use, and separable for access to said nozzle unit.

The airflow duct may have, at each end, unions for connection in a cleaning arrangement.

The juxtaposed parts of the jacket may have flanges for connection to each other, the flanges having ring seals.

One part of the jacket, which, when juxtaposed to the other, surrounds the nozzle, may be slidable along the airflow duct to expose the nozzle. In another arrangement, the airflow duct may itself be in two parts, one part, having the nozzle, being separable from the other together with one part of the jacket so as to expose the nozzle.

In use, to inject liquid into an airflow through the duct, the jacket, the jacket is supplied with liquid, at least to the level of the nozzle inlet. The jacket may, of course, be filled with liquid. The flow of liquid may be controlled by controlling the pressure of the liquid in the jacket, or by positively feeding liquid to the jacket at a predetermined rate, which may be dependent on the rate at which air flows through the airflow duct.

The rate at which liquid can flow through the nozzle may well depend on the nozzle characteristics. The design of the device makes it easy to change nozzles, the airflow duct wall being drilled and tapped, or otherwise adapted, to receive a nozzle of easy removal and substitution.

Embodiments of liquid injection devices according to the invention will now be described with reference to the accompanying drawings, in which.

Figure 1:
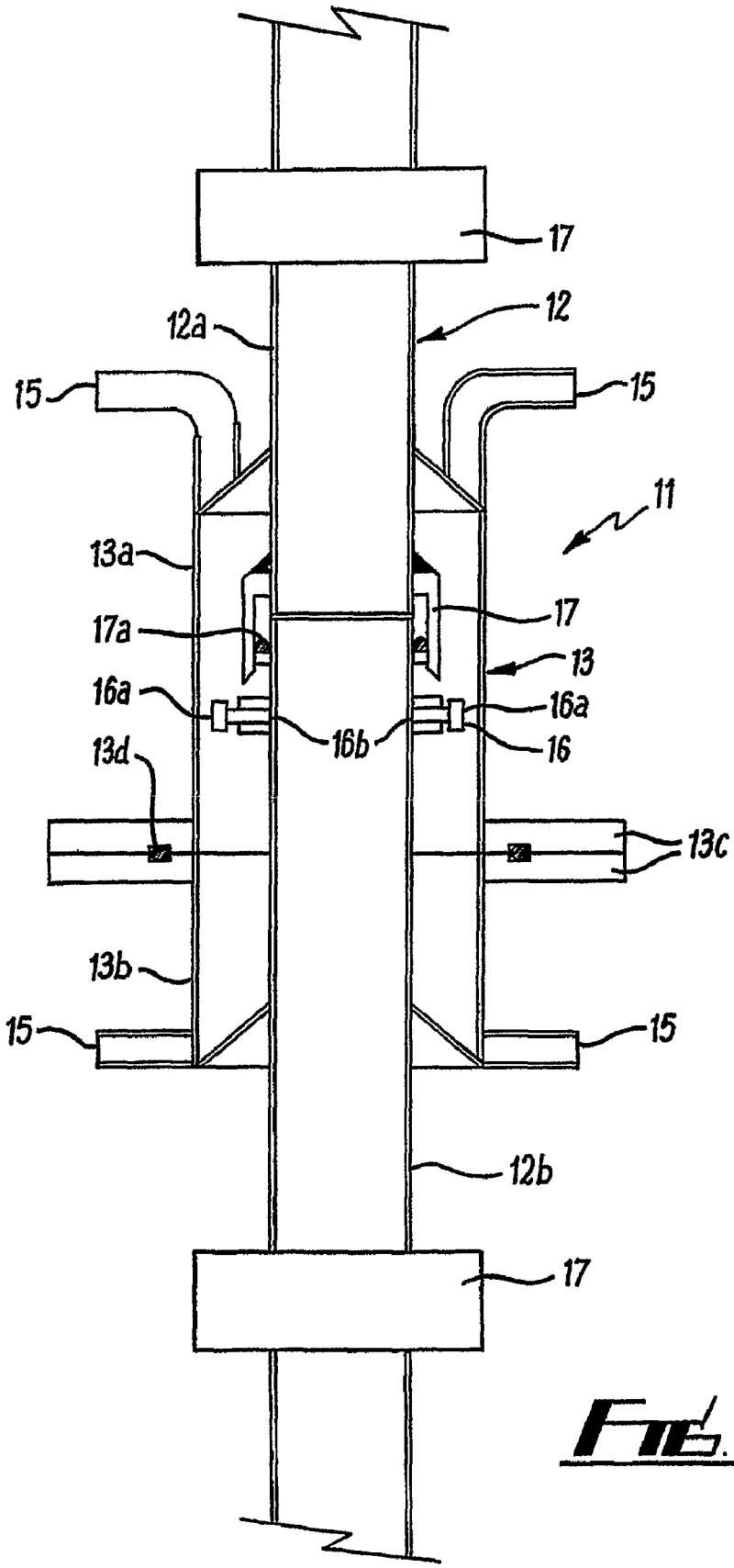
FIG. 1 is an axial section through a first embodiment.

The drawings illustrate a liquid injection device 11 for injecting cleaning liquids into an airflow, comprising:

- an airflow duct 12;
- a jacket 13 surrounding the airflow duct 12, in two parts, 13*a*, 13*b*, axially separable, and having liquid infeed and drain openings 15;
- at least one nozzle unit 16, having an inlet 16*a* opening into the jacket, and its nozzle outlet 16*b* opening into the airflow duct 12;
- the parts 13*a*, 13*b* of the jacket 13 being sealingly juxtaposed for use, and separable for access to said nozzle unit 16.

In this embodiment, there are two nozzles 16.

The airflow duct 12 has, at each end, unions 17 for connection in a cleaning arrangement.

The juxtaposed parts 13*a*, 13*b* of the jacket 13 have flanges 13*c* for connection to each other, the flanges having a ring seal 13*d*.

In the embodiment illustrated in FIG. 1, the airflow duct 12 is also in two parts, one part, 12*b*, having the nozzle, being separable from the other, 12*a*, together with part 13*b* of the jacket so as to expose the nozzles 16. A sealing shroud 17, with an O-ring seal 17*a*, seals the join of the parts 12*a*, 12*b* of the airflow duct 12.

In use, liquid to be fed into the airflow duct 12 is introduced into the jacket 13 through the infeed and drain openings 15. The jacket can be maintained at any desired pressure and temperature so that the liquid enters the airflow duct 12 at a desired rate and in a desired state.

Figure 2:
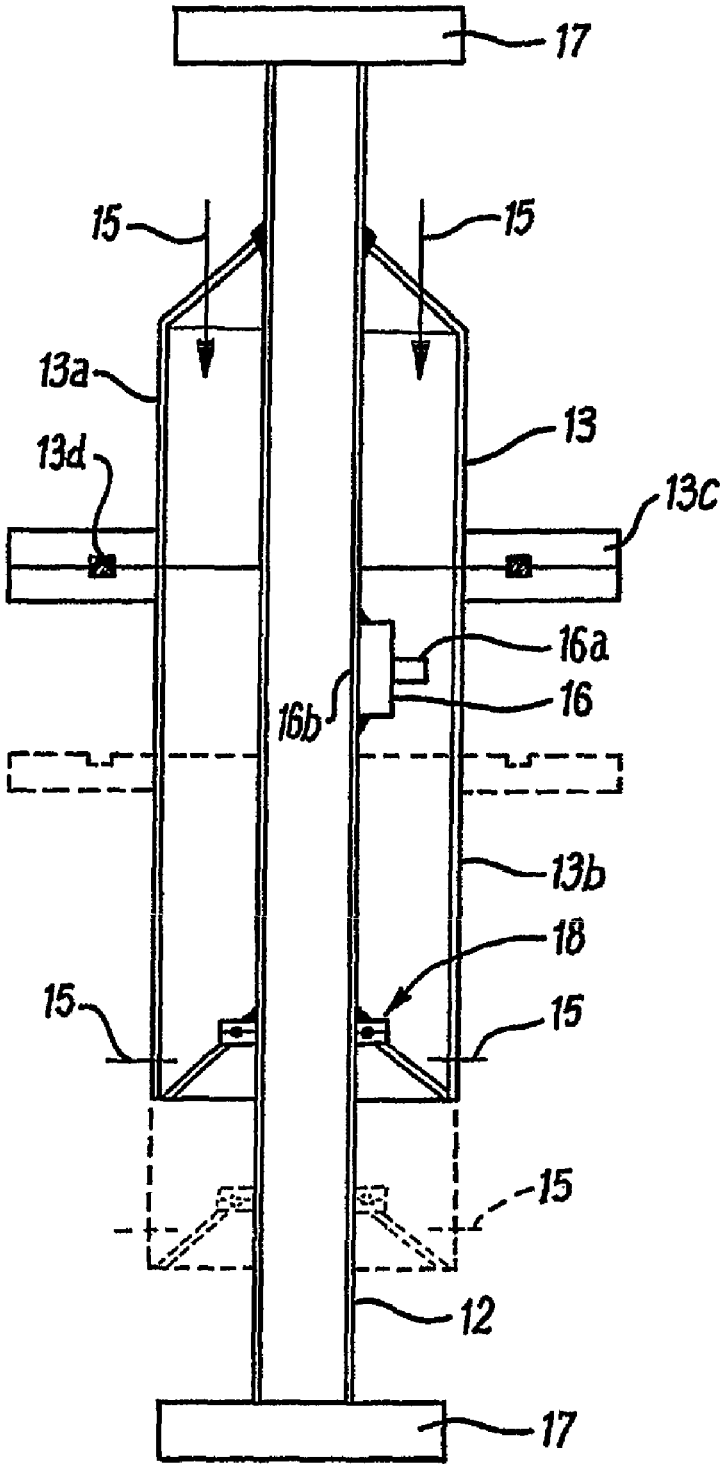
FIG. 2 is an axial section through a second embodiment.

In the embodiment of FIG. 2, the airflow duct 12 is not divided. The part 13*b* of the jacket 13 slides along the duct 12—see the broken line position—away from part 13*a*. When juxtaposed, the jacket is sealed by the flanges 13*c*, with O-ring seal 13*d*, as before, and also by a sealed flange arrangement 18.

Other arrangements are, of course, possible, with the division of the jacket and/or the airflow duct in locations other than those illustrated.

Figure 3:
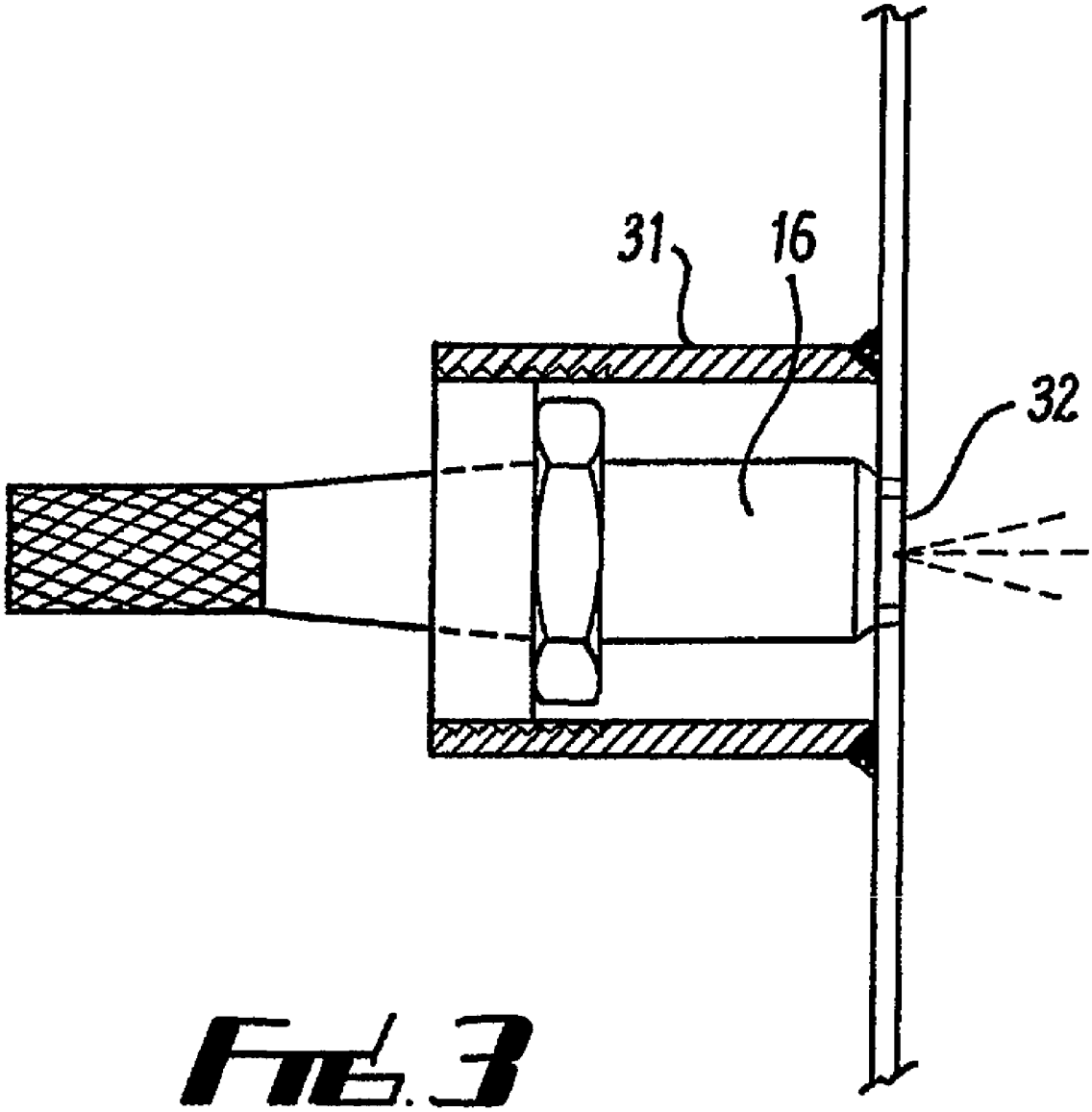
FIG. 3 is an axial section through a nozzle and its location arrangement in an airflow duct wall.

FIG. 3 illustrates the nozzle 16 arrangement. A nozzle, such as a Delavan® type nozzle is mounted in a threaded bush 31 welded to the outer face of the airflow duct 12 and delivers through an aperture 32 in the duct wall. A filter can be fitted, if desired, within the space of the jacket.

The arrangements illustrated provide a simple, but easily accessed and serviced, means of ensuring controlled flow of liquid into an airflow for cleaning purposes. In carrying out operations according to WO0117700, cleaning liquids such as water with added detergent or organic solvents are added in droplet form to a high speed airflow to be swirled around the inner face of a pipe or other duct to be cleaned, and the arrangements are adapted to enable the cleaning liquid to be accurately dispensed and to enter the airflow according to the requirements of the cleaning process.

The invention claimed is:

1. A method for clearing a pipe having a pipe wall, an inlet end and one or more outlets comprising the steps of:

(i) at said inlet end, forcing gas into the pipe with said outlet or at least one of said outlets open to displace pipe contents as a plug and discharge pipe contents forced through by said gas, using gas forcing means capable of maintaining an overpressure sufficient therefore at a low flow velocity;

(ii) when said pipe contents have been discharged, again at said inlet end, and with said outlet or at least one of said outlets open, forcing a gas into the pipe at a lower overpressure and a higher flow velocity to clear contents remaining in said pipe after step (i); and (iii) introducing a cleaning liquid into the pipe after the gas forcing steps, wherein the pipe has at least one nozzle with an outlet opening into the pipe and the step of introducing the cleaning liquid into the pipe comprises the step of injecting the liquid through said nozzle into a high speed airflow in the pipe so that the liquid is swirled around an inner surface of the pipe as a mist of droplets that contact the pipe wall.

2. A method for injecting a liquid according to claim 1 in which a jacket surrounds the pipe, the nozzle communicates between the jacket and the pipe, and the jacket is supplied with the liquid, at least to the level of a nozzle inlet of the nozzle within the jacket.

3. A method according to claim 2, in which the jacket is filled with the liquid.

4. A method according to claim 2, in which flow of the liquid is controlled by controlling the pressure of the liquid in the jacket.

5. A method according to claim 2, in which flow of the liquid is controlled by positively feeding liquid to the jacket at a predetermined rate.

6. A method as claimed in claim 1 which is a lean phase mode cleaning technique.

7. A method for clearing a pipe comprising displacing pipe content by a first, high pressure, low speed air flow to displace the pipe content as a plug followed by a low pressure, high velocity airflow to strip the pipe wall of residual amounts of the pipe content, and subsequently introducing a cleaning liquid into the pipe after the gas forcing steps, wherein the pipe has at least one nozzle with an outlet opening into the pipe and the step of introducing the cleaning liquid into the pipe comprises the step of injecting the liquid through said nozzle into a high speed airflow in the pipe so that the liquid is swirled around an inner surface of the pipe as a mist of droplets that contact the pipe wall.

* * * * *